US010876224B2

(12) United States Patent
Breckner et al.

(10) Patent No.: US 10,876,224 B2
(45) Date of Patent: Dec. 29, 2020

(54) DEVICE AND METHOD FOR SPREADING A FIBER BUNDLE

(71) Applicant: KARL MAYER Technische Textilien GmbH, Chemnitz (DE)

(72) Inventors: Torsten Breckner, Döhlau (DE); Martin Rossner, Bad Steben (DE); Peter Hartmann, Bad Steben (DE); Roland Schmidt, Wallenfels (DE); Stephan Fichtner, Münchberg (DE); Rainer Seuß, Schauenstein (DE)

(73) Assignee: KARL MAYER Technische Textilien GmbH, Chemnitz (DE)

( * ) Notice: Subject to any disclaimer, the term of this patent is extended or adjusted under 35 U.S.C. 154(b) by 116 days.

(21) Appl. No.: 16/026,555

(22) Filed: Jul. 3, 2018

(65) Prior Publication Data

US 2019/0010630 A1 Jan. 10, 2019

(30) Foreign Application Priority Data

Jul. 6, 2017 (EP) ..... 17180086

(51) Int. Cl.
*D01D 11/02* (2006.01)
*D02J 1/18* (2006.01)

(52) U.S. Cl.
CPC ..... *D01D 11/02* (2013.01); *D02J 1/18* (2013.01)

(58) Field of Classification Search
CPC ..... D01D 11/02; D02J 1/18; D02J 1/20; D02J 1/16; D02J 1/02; D02J 1/06; D02J 1/228; D02J 1/229
USPC ..... 28/282
See application file for complete search history.

(56) References Cited

U.S. PATENT DOCUMENTS 2,244,203 A * 6/1941 Kern ..... B41B 11/00 28/282
2,790,208 A * 4/1957 Smith ..... D02J 1/18 19/66 R
3,220,060 A * 11/1965 Agett ..... D02J 1/18 19/65 T
3,440,689 A * 4/1969 Ishikura ..... D01G 1/10 28/282

(Continued)

FOREIGN PATENT DOCUMENTS

DE 2125711 A1 2/1972
DE 102007012607 B4 2/2009

(Continued)

OTHER PUBLICATIONS

Search Report for European Patent Application No. 17180086.5, dated Sep. 18, 2017.

*Primary Examiner* — Amy Vanatta
(74) *Attorney, Agent, or Firm* — Marshall, Gerstein & Borun LLP

(57) ABSTRACT

A device and method for spreading a fibre bundle spread, the fibre bundle being from a fibre bundle supply to a fibre take-up by way of a resistance device, having a first impulse drive that interacts with the resistance device, the fibre take-up being disposed downstream of the resistance device. The fibre bundle by means of the impulse drive during spreading is superimposed in an alternating manner in predefined sequences with an additional speed component in the conveying direction of the fibre bundle and/or with an additional speed component counter to the conveying direction.

18 Claims, 9 Drawing Sheets

(56) References Cited

U.S. PATENT DOCUMENTS

| | | | | | |
|---|---|---|---|---|---|
| 3,465,399 | A * | 9/1969 | Sokolowski | D02J 1/18 | 28/282 |
| 3,535,745 | A * | 10/1970 | Zeidman | D01D 11/02 | 28/283 |
| 3,708,832 | A | 1/1973 | Lohrke | | |
| 3,840,941 | A * | 10/1974 | Neveu | B65H 51/005 | 28/220 |
| 3,961,396 | A * | 6/1976 | Lubitzsch | D01D 11/02 | 19/65 T |
| 4,959,895 | A * | 10/1990 | Sager | B65H 51/005 | 228/1.1 |
| 5,101,542 | A * | 4/1992 | Nakagawa | B65H 51/005 | 19/65 T |
| 8,191,215 | B2 | 6/2012 | Meyer | | |
| 2014/0182779 | A1 | 7/2014 | Yamashita et al. | | |
| 2017/0355550 | A1* | 12/2017 | Kawahara | D01D 11/02 | |
| 2019/0256317 | A1* | 8/2019 | Fernando | B65H 51/005 | |

FOREIGN PATENT DOCUMENTS

| | | | |
|---|---|---|---|
| EP | 1184496 | A2 | 3/2002 |
| EP | 1172191 | B1 | 8/2004 |
| EP | 2213775 | A1 | 8/2010 |
| EP | 2569469 | B1 | 5/2014 |
| JP | 2003064550 | A | 3/2003 |
| JP | 2005029912 | A | 2/2005 |

* cited by examiner

DEVICE AND METHOD FOR SPREADING A FIBER BUNDLE

CROSS-REFERENCE TO RELATED APPLICATIONS

The priority benefit of European Patent Application No. 17 180 086.5, filed Jul. 6, 2017, is hereby claimed and the entire contents thereof are incorporated herein by reference.

FIELD OF DISCLOSURE

The invention relates to a device for spreading a fibre bundle, and to a respective method.

BACKGROUND

Devices and methods for spreading fibre bundles are known. A device and a method for distributing fibre bundles for a continuous production of so-called prepregs is described in EP 2 569 469 B1. The device has a so-called tension build-up unit which is composed of a series of statically disposed round rods, and a tension reduction unit which is composed of a series of driven rollers, wherein the static rods and the driven rollers are disposed so as to be perpendicular to the direction of the fibre bundle running through, said fibre bundle forming a sheathing contact with the surface of the series of static rods and driven rollers. The driven rollers are operated at a comparatively high differential speed in relation to the speed of the running fibre bundle, on account of which a spreading effect of the fibre bundle is achieved. In the case of this device, or of this method, respectively, the fibre bundles first form a direct sheathing contact with the surface of the static bars, so as to subsequently establish a direct sheathing contact with the series of driven rollers, or idler rollers, respectively. In order for the required spreading effect to be achieved, the driven rollers are operated at circumferential surface revolutions which are at least three times the speed of the running fibre bundle. The tension of the fibre bundle is controlled by way of this speed differential.

A method and a device for orienting skein webs are described in DE 2 125 711. Skein webs herein are textile materials in which the individual threads are distributed in a continuous thread web, this being said skein web, in a uniform manner in the transverse direction of said skein web. This treatment of the skein web that in the publication mentioned is referred to as orienting corresponds to the actual spreading. The skein web herein under tension is moved forward, said tension however being sufficiently low such that the threads do not break. The skein webs are guided in such a manner over rollers and a plurality of grooved units in groups that are rotatably driven such that the skein web is separated by the webs located between the grooves and is thus displaced in the transverse direction, wherein smoothing of the skein web is performed in that the skein web after the splitting of the latter is guided in an again deflected manner by way of stationary bars. It is disadvantageous in the case of this method that the formation of lanes in the case of spread skein webs is not avoided, above all not when comparatively low weights per unit area are to be targeted. The tendency towards forming lanes increases the higher the degree of spreading, and thus the lower the weight per unit area of the spread fibre bundle.

A spreading device for spreading a fibre filament bundle so as to form a flat fibre tape is described in DE 10 2007 012 607 B4. The known spreading device has a spreading edge that is curved in a convex manner, said spreading edge impinging the fibre filament bundle that is to be spread and is guided over the spreading edge with a direction component perpendicular to the longitudinal extent of the fibre filament bundle. The fibre filament bundle under tension is capable of being placed onto the convexly curved spreading edge and is subsequently capable of being moved away again by way of at least one direction component perpendicularly from the filament fibre bundle. This known device is now characterized in that rotating shafts having convexly curved rods are grouped together in a device such that the convexly curved bars that serve as rotating blades on account of the rotatingly driven rotating shafts mutually engage such that fibre filament bundles that have been introduced under tension into the spreading device are capable of being tensioned apart by way of a varying tension force between the edge regions. On account of the varying tension force, it is to be achieved that the filaments are gradually repositioned in the width direction such that a spread tape is present upon exiting the spreading device. The disadvantage of devices of this type lies in that low weights per unit area are difficult to achieve when the formation of lanes is to be avoided.

Finally, a production device and a production method for open fibre bundles, and a prepreg production method are known from EP 1 172 191 B1. The spreading device has two rollers which are kept in contact with a running fibre bundle, and a main body which moves in a reciprocating manner so as to be repeatedly and periodically brought in contact with the running fibre bundle and moved away from the latter again. The assembly is now configured in such a manner that the running fibre bundle is not imparted any pressure between the rollers when said fibre bundle is not in contact with the rollers. According to one exemplary embodiment, the circumferential surface speed of at least one of the rollers is kept lower than the running speed of the running fibre bundle. On account thereof, tension is applied to the material to be spread. According to the known method, the main body is pivoted in a reciprocating manner at an oscillation frequency and a defined amplitude such that the fibre bundle bears on the rollers.

All these known devices and methods have in common that relatively uniform and positive spreading of the fibre bundles is indeed already achieved by way of various principles, the low weight per unit area to be targeted however not being able to be achieved, or if at all to only a very limited extent, when the formation of lanes is to be avoided.

GENERAL DESCRIPTION

By contrast with the known prior art, it is the object of the present invention to achieve a device and a method for spreading a fibre bundle, by means of which device or method, respectively, a high quality and uniformity of the spread fibre bundle, specifically paired with an extremely low weight per unit area to be achieved, and a high production speed are achieved.

The device for spreading a fibre bundle generally has a fibre bundle supply from which the fibre bundle to be spread is conveyed and is feedable to a fibre consumer by way of a resistance and of at least one first impulse drive that interacts with the resistance. The fibre bundle supply is in particular wound on a package, from which the fibre bundle, having passed through the actual device for spreading and now being spread, is feedable to a fibre consumer, wherein the fibre consumer represents either a winding roller that in terms of width is configured so as to correspond to the spread, or a direct depositing, for example in the manner of segments, onto a multi-axial cross-laid structure. In any case, the fibre consumer is constructed such that said fibre consumer is capable of exerting a corresponding drawing-off tension on the completely spread fibre bundle. According to the invention, the fibre bundle by means of the impulse drive during spreading is now impinged in an alternating manner in predefinable frequencies with an additional speed component in the conveying direction of said fibre bundle, and with an additional speed component counter to the conveying direction. However, it is also possible for the fibre bundle during spreading to be impingeable in predefined sequences with an additional speed component only in the conveying direction of the fibre bundle, or in predefinable sequences only counter to the conveying direction of the fibre bundle.

This aspect of providing an impulse drive is not described anywhere in the case of the known spreading devices. The principle according to the invention lies in that the fibre bundle for the purpose of effective spreading of fibre bundles of dissimilar materials is impinged in the direction of the running direction of the fibre bundle and/or counter to said running direction of the fibre bundle with a respectively directed speed component. The speed varying in this manner by way of which the spreading procedure is additionally impinged in a sequenced manner, or a pulsating manner, respectively, in the manner of a sinus curve with the conveying speed, or the running speed, respectively, leads to the fibre bundle during the entire spreading procedure being subjected in a sequential manner to a change between a build-up of tension and a relief of tension, the individual filaments of the fibre bundle on account thereof being able to be spread more easily and more effectively. The impinged speed components by way of which the fibre bundle running through the device is impinged additionally to the running speed are however only so large that the filaments to be spread of the fibre bundle do not incur any damage when spread, that is to say do not incur any substantial damage.

By way of this device according to the invention, that is to say only using said impulse spreading, it is possible for spreading results which achieve an extremely low weight per unit area to be achieved. It has been demonstrated that weights per unit area of even approx. 16 g/m$^2$ are achievable. The spreading device at all times operates by way of an interplay between the impulse drive and the counter bearing, or the resistance, respectively. In terms of the counter bearing, it is to be stated that the latter in the most simple form thereof can be composed of a single deflection rod by way of which the fibre bundle from the fibre bundle supply, which is preferably a driven package, is feedable to the actual impulse drive in a manner deflectable by way of a defined wrapping angle. On account of the effect of the impulse drive, a comparatively large spread is already implemented on a single spreading rod after the drawing-off from the package. A substantial advantage of the device according to the invention lies in that all spreadable materials, including steel, can be spread to very low weights per unit area at a high quality and without lanes. A further substantial advantage lies in that very large spreading can already be performed between the fibre bundle supply and the first resistance when the fibre bundle supply is preferably already configured as an additional impulse drive. Spreading degrees from 25° to 30° can thus be achieved on, or after, respectively, the first resistance, this corresponding to 8 to 10 times the achievement that is possible in the case of known devices in normal spreading. The extremely large advantage of the device according to the invention already becomes obvious herein, and a substantial reason for very high spreading degrees and thus very low weights per unit area which cannot even be attempted to be achieved using devices according to the prior art also lies herein.

The predefinable sequences of the additional speed components by means of a control installation for the impulse drive for achieving a predefinable weight per unit area are preferably variable in terms of the frequencies and/or amplitudes of said sequences. It is in particular preferably provided that the control installation controls the impulse drives in terms of the frequencies and the amplitudes of the latter, or in terms of the frequencies or the amplitudes of the latter, respectively, in a corresponding manner, depending on the material to be spread and the weight per unit area to be achieved. An extremely high flexibility of the device in terms of the desired spreading result to be achieved in the most varied of materials of the fibre bundle to be spread results on account thereof.

In terms of the resistance necessary for the device, it is provided that said resistance has at least one spreading rod that is disposed so as to be deflected transversely to the conveying direction of the fibre bundle, the fibre bundle being guidable by way of a defined wrapping angle over said spreading rod. The defined wrapping angle herein is formed so as to correspond to the transverse offset of the spreading rod in relation to the conveying plane that is defined by the spread fibre bundle. The resistance can preferably also be a blower or suction installation, and can also be configured as a clamping installation of a mechanical type or an electromagnetic type, or as an electromagnetic fibre bundle deflection device. It is essential that the resistance according to the invention is exerted on the spread fibre bundle running through the spreading device in such a manner that the individual filaments of the fibre bundle are forced to be increasingly disposed beside one another such that spreading of the fibre bundle that is drawn off or conveyed away from the fibre bundle supply is performed.

It is furthermore preferably provided for the device that the fibre bundle supply is disposed on a not freely rotating package and is capable of being drawn off from the latter. The package in the conveying direction of the fibre bundle is disposed ahead of the resistance, the first impulse drive being disposed behind the latter. This sequence guarantees that the fibre bundle by way of the resistance is drawn off counter to the braking effect of the package such that the fibre bundle is at all times impinged with tension. The running speed of the fibre bundle supply through the device according to the invention by way of the impulse drive is impinged additionally with a corresponding speed component which is substantially impinged in the direction of the plane that is formed as the conveyed bundle runs through the spreading device, specifically in the direction of the passage of the fibre bundle, or else counter to the direction of the fibre bundle, respectively, through the spreading device. Conveying in the conveying direction, and conveying counter to the conveying direction, are herein performed in a sequentially alternating manner. In principle, however, it is also possible for only speed components in the conveying direction to be impinged, said speed components in the conveying direction in a sinusoidal manner increasing from zero to a maximum value so as to subsequently drop to zero again; a negative speed component in the sense of a speed component which is directed counter to the conveying direction of the spread fibre bundle would not be provided in this case.

According to a refinement, the not freely rotating package is preferably configured as a driven package which in particular is a package that in predefinable sequences is driven in a pulsating manner in the rotation direction in the manner of a second impulse drive. The predefinable sequences of the speed components of this second impulse drive are out of phase in relation to those of the first impulse drive. Double influencing of the impulses of the fibre bundle to be spread can thus be achieved, because the fibre bundle to be spread can be impinged in an alternating manner in predefinable sequences with the additional speed components with which the fibre bundle is impingeable already ahead of the resistance as well as behind the resistance. The spreading result in terms of the precision and the quality of spreading, that is to say in terms of avoiding thread lanes after spreading has been performed, as well as in terms of achieving a very low weight per unit area can thus be even further improved.

According to one further embodiment, it is preferably also provided that the resistance is disposed downstream of the first impulse drive. In such a case, only the first impulse drive is preferably provided for the spreading device.

When the resistance according to the embodiment of the invention mentioned above is disposed so as to be downstream of the first impulse drive, the device in this instance is preferably configured such that the spread fibre bundle is received on a consumer that is disposed downstream of the resistance and is configured as a winder. Therefore, the device in principle is composed of the fibre bundle supply, the first impulse drive, the resistance, and the consumer, for example in the form of a winder. It is also preferably possible and conceivable herein that the fibre bundle supply is configured as the first impulse drive, in particular in the form of a driven package.

The winder is furthermore preferably driven at a constant winding-up speed. The constant winding-up speed is to ensure that the fibre bundle during spreading is impinged with a tensile force. The tensile force herein can preferably be of such a magnitude that, even in the case of an additional speed component that in the sense of a negative speed component is directed counter to the running direction of the spread fibre bundle, the resulting speed, calculated from the running speed of the fibre bundle and from the additional speed component that is directed counter to the running direction, is positive. However, it is also possible for the additional speed component to have a magnitude of such a manner that the resulting speed, calculated from the running speed of the fibre bundle and from the additional speed component that is directed counter to the running direction, is at least briefly zero.

According to yet another refinement, it is provided that the winder of the device is preferably configured so as to be driven in the manner of a second, additional impulse drive, the predefinable sequences of the speed components of the latter being out of phase to those of the first impulse drive. The predefinable sequences of the speed components with which the fibre bundle during the spreading procedure when running through the device is impinged, for example on account of such a package that in predefinable sequences is driven in a pulsating manner in the rotation direction in the manner of a second impulse drive, quasi mill the fibre bundle, on account of which the individual filaments are supported in the desire of the latter to be disposed beside one another. Ideally, it can be achieved by way of the impulse drive according to the invention, or by way of the device having impulse drives of this type, respectively, that an almost ideal spread is achieved, in which the desired extremely low weights per unit area are achievable and in which spreading is performed in an ideal manner such that the formation of lanes is only just avoided, but one filament is disposed beside the next filament. However, it is in principle also possible herein for spreading to be pushed to the extent that the individual filaments are disposed even at a certain mutual spacing. Such tiers that are later to be generated in multi-axial cross-laid structures can be quite purposeful, depending on the application. The weights per unit area of tiers of this type can be even lower than has been stated above.

According to yet another refinement, it is preferably provided that, instead of the configuration of the winder, or of the thread consumer, respectively, in the form of a second, additional impulse drive, an additional, second impulse drive which is not the winder is disposed downstream of the resistance, said second impulse drive nevertheless having the fundamental functional mode of the impulse drives, specifically generating predefinable sequences of the speed component so as to be out of phase in relation to those of the first impulse drive.

According to yet another refinement, in the presence of a first impulse drive and of a second, additional impulse drive, controlling can now be performed such that either the first or the second additional impulse drive operates as an impulse drive, that impulse drive that does not impinge the fibre bundle with predefinable sequences of the speed components during spreading being quasi neutralized. Neutralizing here is understood such that the fibre bundle is not impinged with the predefinable sequences of the speed components in the case of the ineffective impulse drive, but that the fibre bundle merely runs through the impulse drive without any effect of this type.

According to a second aspect of the invention, the method for spreading a fibre bundle according to the invention at defined conveying speeds comprises a first step according to the invention, in which step the conveying speed of the fibre bundle during the spreading procedure is impinged with a pulsating speed component. This pulsating speed component in predefinable sequences in an alternating manner is directed in the direction of the conveying speed, and counter to said direction, or is directed only in the conveying direction or only counter to the conveying direction of the fibre bundle during spreading.

According to the invention, it is at least necessary that, besides delivering a fibre bundle to be spread from a fibre bundle supply, and the fibre bundle consumer that is present after spreading, at least one resistance and one impulse drive are provided, the actual spreading of the fibre bundle being implemented by the interaction of said resistance and said impulse drive.

According to the method according to the invention, in a refinement the fibre bundle is impinged with the pulsating speed component by means of a first impulse drive.

According to a further refinement, the fibre bundle is impinged with the pulsating speed component by means of the first and by means of a second impulse drive, wherein the respective speed components from the first impulse drive and from the second impulse drive are introduced into the fibre bundle by mutually offset phases. The respective out-of-phase speed components from the first and from the second impulse drive serve for quasi milling the fibre bundle to be spread through the sequences of the respective impulse drive that are predefinable in the rotation direction, such as for example of a package that is drivable in this manner, so as to further improve the spreading result.

In addition to the so-called milling of the fibre bundle to be spread during the spreading procedure, it can preferably be provided that the fibre bundle to be spread by the device according to the invention is additionally impinged transversely to the conveying direction of the fibre bundle with an oscillating component. This has the advantage that the spreading result can be further improved because, to this extent, a further physical spreading principle is applied, specifically the application of an oscillating component that is substantially perpendicular to the conveying direction of the fibre bundle by the device. It is understood that the impulse spreading according to the invention, or a device implementing the impulse spreading, respectively, can be combined with the known spreading techniques for fibre bundles.

The production speed, which is also referred to as the line speed, is preferably 8 m/min, and the amplitude of the speed, which is added to the production speed or is subtracted therefrom, is preferably 3 m/min, the production speed being impinged at a preferable frequency of 2 Hz.

BRIEF DESCRIPTION OF THE DRAWINGS

Further advantages, details, and concrete potential applications of the invention will now be explained in detail by means of the appended drawing in which.

DETAILED DESCRIPTION

Figure 1:
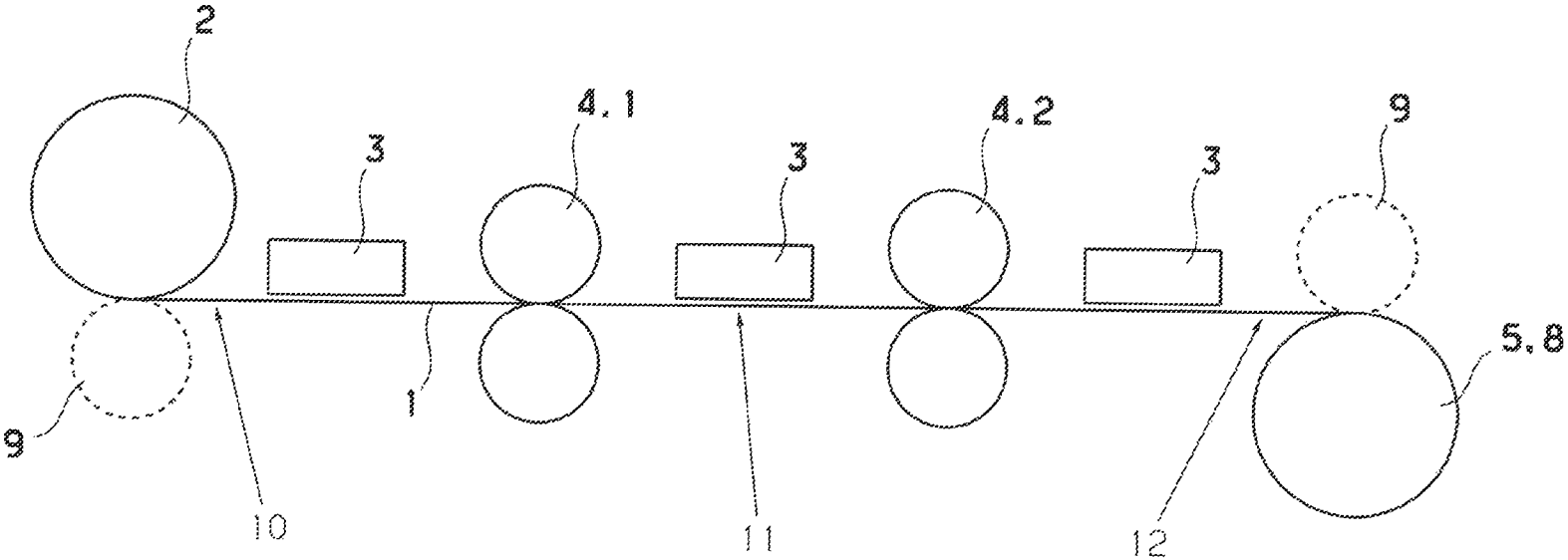
FIG. 1 shows an overall assembly of a spreading device according to the invention, having at least two impulse drives and in each case one resistance disposed ahead of and behind said impulse drives, said impulse drives and resistances acting on the fibre bundle running through the device.

A spreading system which has at least two impulse drives and the resistances which interact with the latter and are in each case disposed upstream or downstream of the latter is illustrated in FIG. 1, wherein the fibre bundle to be spread is fed from a fibre bundle supply 2 to a fibre consumer 5 in the manner of a winder 8 by way of a resistance 3, through a first impulse drive 4.1 and in turn by way of a further resistance 3 and a second impulse drive 4.2 and in turn by way of a resistance 3. The fibre bundle 1 by means of a counter pressure roller 9 is pressed onto the fibre bundle supply 2 which is drawn off, or depleted, in the manner of a not freely rotatable package. A counter pressure roller 9 of this type is likewise provided on the fibre consumer 5, or the winder 8, respectively, so as to guarantee that the spread fibre bundle 1 is wound up in an orderly manner. The not freely rotatable counter pressure roller 9 is moreover expedient or necessary, respectively, for conveying the fibre bundle 1 in a targeted manner. In the case of a combination of a package of this type and the counter pressure roller 9, or of the winder 8 and the counter pressure roller 9, controlling can in each case be performed in such a manner that said combinations per se represent an impulse drive.

The fibre bundle by means of the infeed speed is fed from the fibre bundle supply 2 to the resistance 3 and from there to the first impulse drive 4.1. The infeed speed 10 in terms of the rate thereof can be varied by virtue of impinging an additional speed component in the conveying direction of the fibre bundle through the device, or counter to said conveying direction, and runs as the conveying speed 11 from the first impulse drive 4.1 by way of the resistance 3 to the second impulse drive 4.2. The second impulse drive 4.2 likewise impinges the fibre bundle to be spread with an additional speed component in the conveying direction of the fibre bundle through the spreading device and/or counter to the conveying direction through the spreading device. The fibre bundle 1 makes its way from the second impulse drive 4.2 by way of a further resistance 3 to the fibre consumer 5, or the winder 8, respectively. The spread fibre bundle by means of the fibre consumer 5, or the winder 8, is wound up at the production speed 12 onto the fibre consumer 5, while being simultaneously pressed thereon by means of a counter pressure roller 9.

Figure 2:
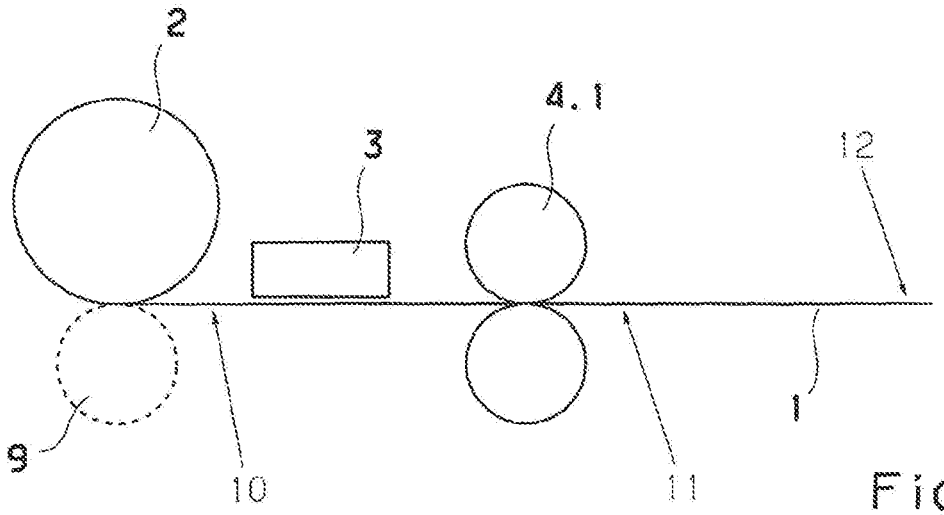
FIG. 2 shows a device according to the invention according to a first exemplary embodiment, which is configured only from a non-driven package, a resistance, and a first impulse drive, and a fibre bundle consumer (not illustrated)

A further exemplary embodiment of the device according to the invention is illustrated in FIG. 2. In this exemplary embodiment illustrated, a reduced number of components as compared to the comprehensive exemplary embodiment described in FIG. 1 are present for the device according to the invention to function. A non-driven package from which the fibre bundle material is drawn off and is fed to a resistance 3 at the infeed speed 10 that is provided by the package serves as the fibre bundle supply, or the thread provision 1. The resistance is disposed ahead of an impulse drive. This impulse drive represents the first and only impulse drive in the case of this embodiment. After the impulse drive 4.1, the fibre bundle that by the effect of the impulse drive 4.1 has been spread departs the impulse drive 4.1 at the conveying speed 11 so as to be subsequently fed to a consumer (not specified in more detail here) at the production speed 12. When no further element of the device is disposed downstream of the impulse drive 4.1, it can be assumed that the conveying speed 11 at a certain distance following the impulse drive 4.1 corresponds approximately to the production speed 12. The assembly according to FIG. 2 corresponds to the fibre bundle being drawn off, or conveyed, respectively from a cardboard box. To this end, a counter tension, for example in the form of a brake (not shown), is required ahead of the resistance 3.

Figure 3:
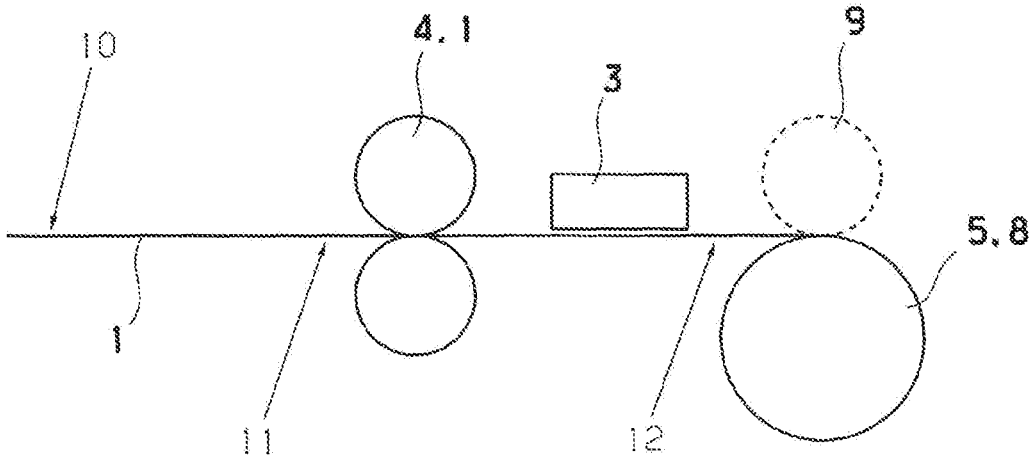
FIG. 3 shows a second exemplary embodiment in which the device has a fibre bundle supply (not illustrated), a first impulse drive followed by a resistance and the latter followed by a fibre bundle consumer.

FIG. 3 shows a further exemplary embodiment in which an impulse drive 4.1 is provided, the fibre bundle 1 running through the impulse drive 4.1 being impinged with the additional speed component of said impulse drive 4.1, wherein a fibre bundle supply is not indicated in the drawing such that it remains open to interpretation in the case of this exemplary embodiment from where and in which form the fibre bundle 1 is fed to the first impulse drive 4.1. Infeeding can also be performed, for example, from cardboard boxes in which the non-spread fibre bundle is deposited in loops in the form of a roving. In any case, the fibre bundle is fed to the first impulse drive 4.1 at the infeed speed 10, the latter in this exemplary embodiment corresponding approximately to the conveying speed 11 at which the fibre bundle enters the first impulse drive 4.1. The fibre bundle in the first impulse drive 4.1 is impinged with an additional speed component in the direction of the conveying installation of the fibre bundle through the device and/or counter to said conveying installation, such that the fibre bundle is quasi milled. The already spread fibre bundle from the impulse drive 4.1 makes its way by way of a downstream resistance 3 to a fibre bundle consumer 5 which is provided in the form of a winder. A counter pressure roller 9 or a contact pressure roller is provided on the winder on the winding-up point, so as to guarantee a uniform winding-up of the spread fibre bundle 1. The winder is configured so as to be driven such that the interaction of the impulse drive 4.1 and the downstream resistance 3 is guaranteed by way of the tension that is maintained in the fibre bundle 1, or in the spread tape, respectively, by the driven winder 8. The driven winder 8 can be operated at a constant winding-up speed, on the one hand, that is to say that said winder 8 always operates at the conveying speed. However, it is also possible for the winder 8 to be configured as an additional impulse drive 4.2, wherein the winder 8, or the additional impulse drive 4.2, respectively, and the first impulse drive which is disposed ahead of the resistance 3 must be controlled such that the speed components which are impinged and vary in the manner of a sinus function of the additional, second impulse drive and of the first impulse drive must be temporarily offset, that is to say out of phase with one another, wherein this temporal offset must not be equal to 0°, that is to say must be in the range from 1° to 359°.

Figure 4:
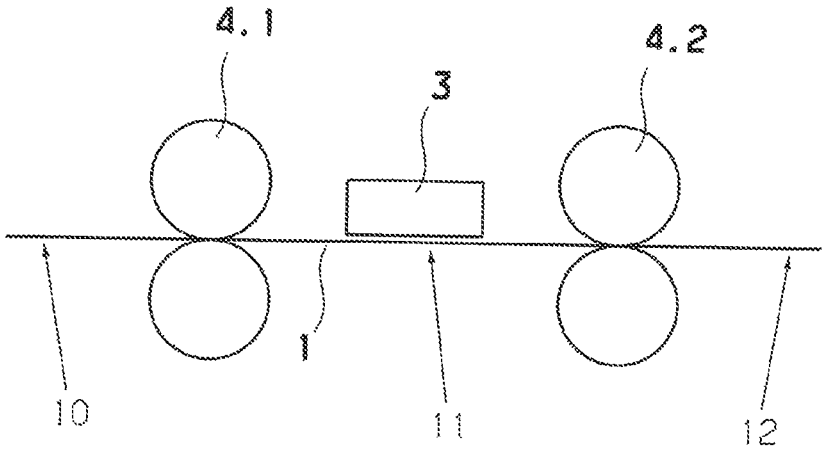
FIG. 4 shows a further exemplary embodiment which has two impulse drives, one resistance being provided between said two impulse drives, wherein the fibre bundle supply and the fibre bundle consumer are not illustrated.

A further exemplary embodiment is finally illustrated in FIG. 4, in which exemplary embodiment a first impulse drive 4.1 and a second impulse drive 4.2 are provided, one resistance 3 being disposed therebetween. The first impulse drive 4.1 and the resistance 3 and the second impulse drive 4.2 interact with one another and cause the so-called milling of the fibre bundle 1 when running through the spreading device. This simplified basic system of a device according to the invention, composed of two impulse drives 4.1 and 4.2 and an interposed resistance 3, leaves it open to interpretation from which fibre bundle supply the fibre bundle 1 is fed to the first impulse drive 4.1 at the infeed speed 10, and how the fibre bundle 1 exiting the second impulse drive 4.2 at the production speed 12 is fed to which fibre bundle consumer. This arrangement according to this exemplary embodiment can in principle be found again in the exemplary embodiment according to FIG. 1 in which a driven package is present as the additional impulse drive, as well as in the exemplary embodiment according to FIG. 2 in which a winder 8 is provided as the additional impulse drive.

Numerous possible variants can be considered for the resistance. These include, for example, rollers having elastic protrusions which clamp the fibre bundle only in the event of protrusions rolling on one another, said rollers however allowing the filaments to slide between the protrusions such that a variation in terms of tension is produced permanently on the fibre bundle. Likewise, a roller pair which does not impinge the fibre bundle with a speed variation component exerted on the fibre bundle in rotation but which impinges the fibre bundle with an oscillating, reciprocating movement component that is performed in the direction of the running direction of the fibre bundle is conceivable as a further example. Moreover, a clamping conveyor chain, as well as a hydraulically or pneumatically or similarly impinged wide-slot nozzle, or a plurality of wide-slot nozzles of this type, respectively, can be used as the resistance, or else an electromagnetic configuration for a member that in an alternating manner clamps and releases the fibre bundle can be provided.

Figure 5A:
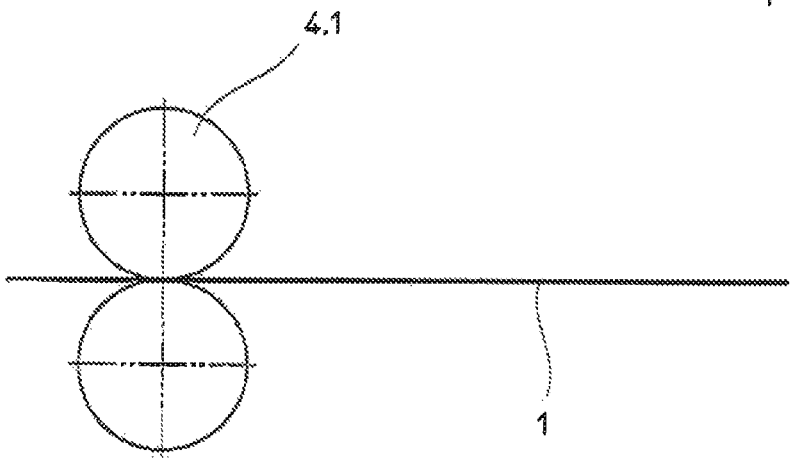
FIG. 5*a*) shows a first impulse drive through which the fibre bundle to be spread is guided.
Figure 5B:
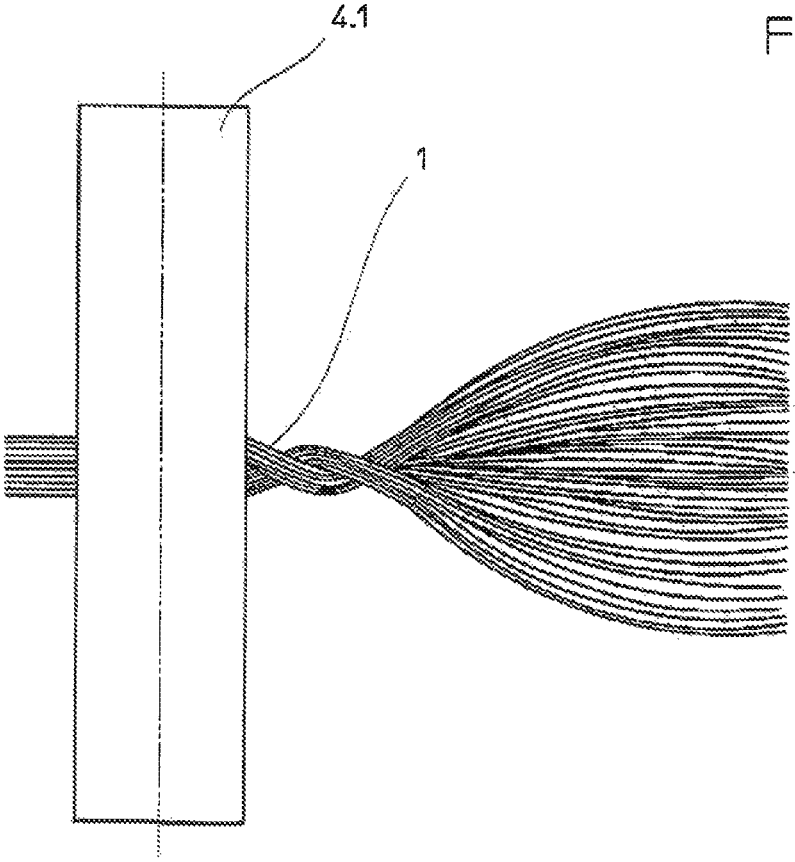
FIG. 5*b*) shows the illustration according to FIG. 5*a*) in plan view, from which it can be seen that distortions and entanglements, respectively, when spreading on the first impulse drive remain thereon and the spread fibre bundle is fed to the further part of the spreading device in an entirely untangled manner in order for said fibre bundle to be further spread.

A first impulse drive illustrated as a roller pair is illustrated in FIG. 5, in a side view according to FIG. 5*a*) and in plan view according to FIG. 5*b*). It is to be noted that, by virtue of the operating mode of the impulse drive 4.1 in which the fibre bundle 1 in an alternating manner in predefinable sequences is impinged with an additional speed component in the conveying direction and/or counter to said conveying direction, it is achieved that entanglements of the fibre bundle remain at the location of spreading in the impulse drive 4.1, or else on the first member on which spreading is performed, specifically a spreading rod, and are not transmitted further into the device. Rather, only the already uniformly spread fibre bundle is transmitted into the device such that a uniform product that does not display any irregularities in the distribution of density of the filaments can be produced. These entanglements are also referred to as twisters and must be avoided under all circumstances. These twisters are above all present in the case of fibre tapes which in cross-wound packages form the reversal of direction on the outer right and left periphery and in the unwinding procedure tend to tilt. Twisters of this type in the case of known spreading devices could not be excluded in the spreading process. The twisters in the case of tiers having a high weight per unit area have only a subordinate role because said twisters to this extent are not conspicuous and can thus be tolerated. In the case of low weights per unit area, twisters are a so-called knockout criterion. It is interesting that the twisters in the case of the spreading device according to the invention are forced back to the first impulse drive, because said twisters are ideally compensated for by twisters having an opposed twist. An impulse drive can also be considered to be, or be referred to as, respectively, a nip roller. As an overall result, new economical possibilities for creating fibre-reinforced components are therefore derived, since unidirectional tiers, or multi-axial cross-laid structures, respectively, having a very low weight per unit area can be used in a targeted manner based on the desired strength actually required.

Figure 6:
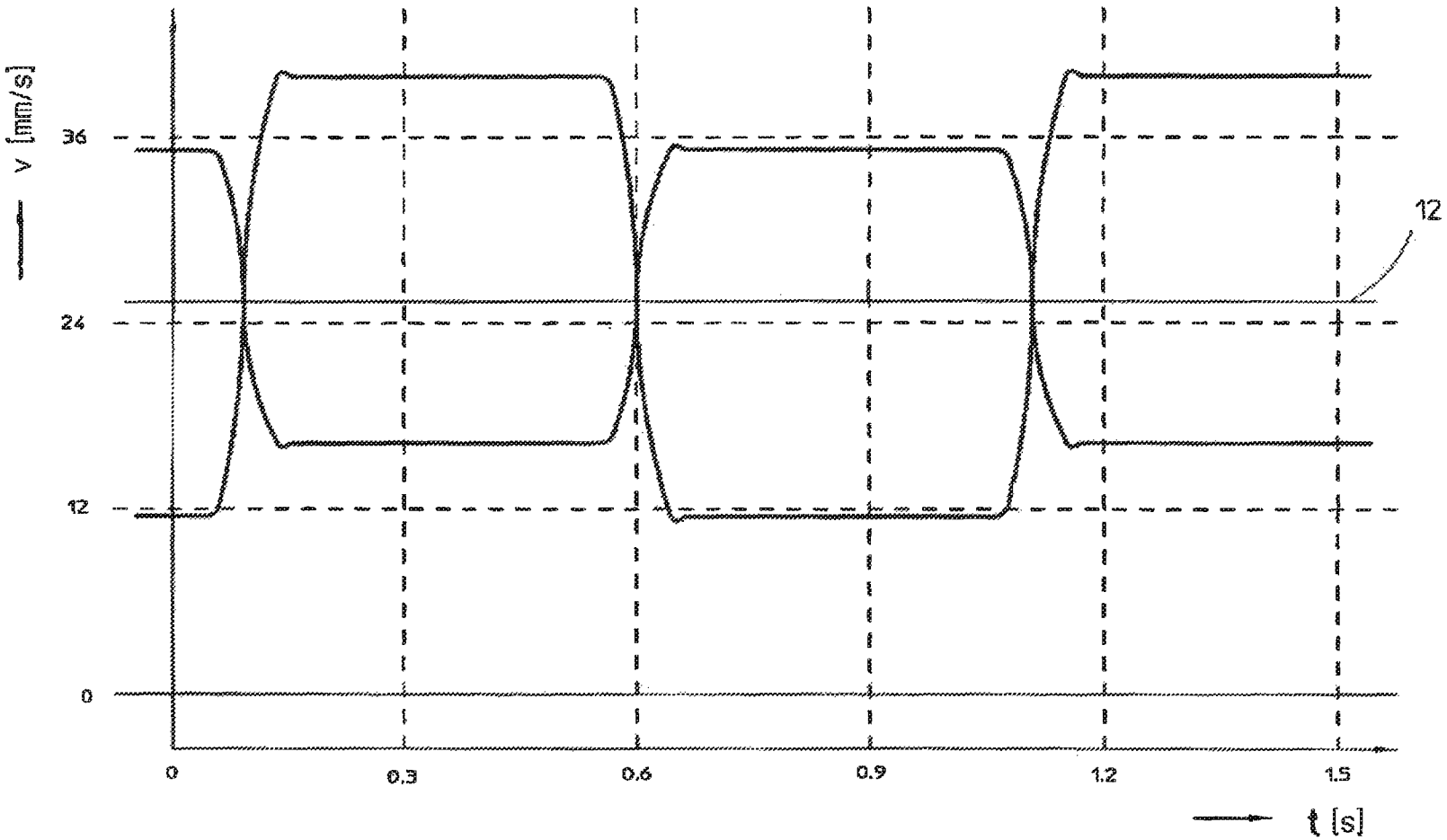
FIG. 6 in a schematic illustration shows the additional speed component of a first impulse drive and, out of phase in relation thereto, the additional speed component of the second impulse drive with which the fibre bundle to be spread, or the running speed of the latter, respectively, is impinged in the manner of a sinus curve in an oscillating manner.
Figure 7:
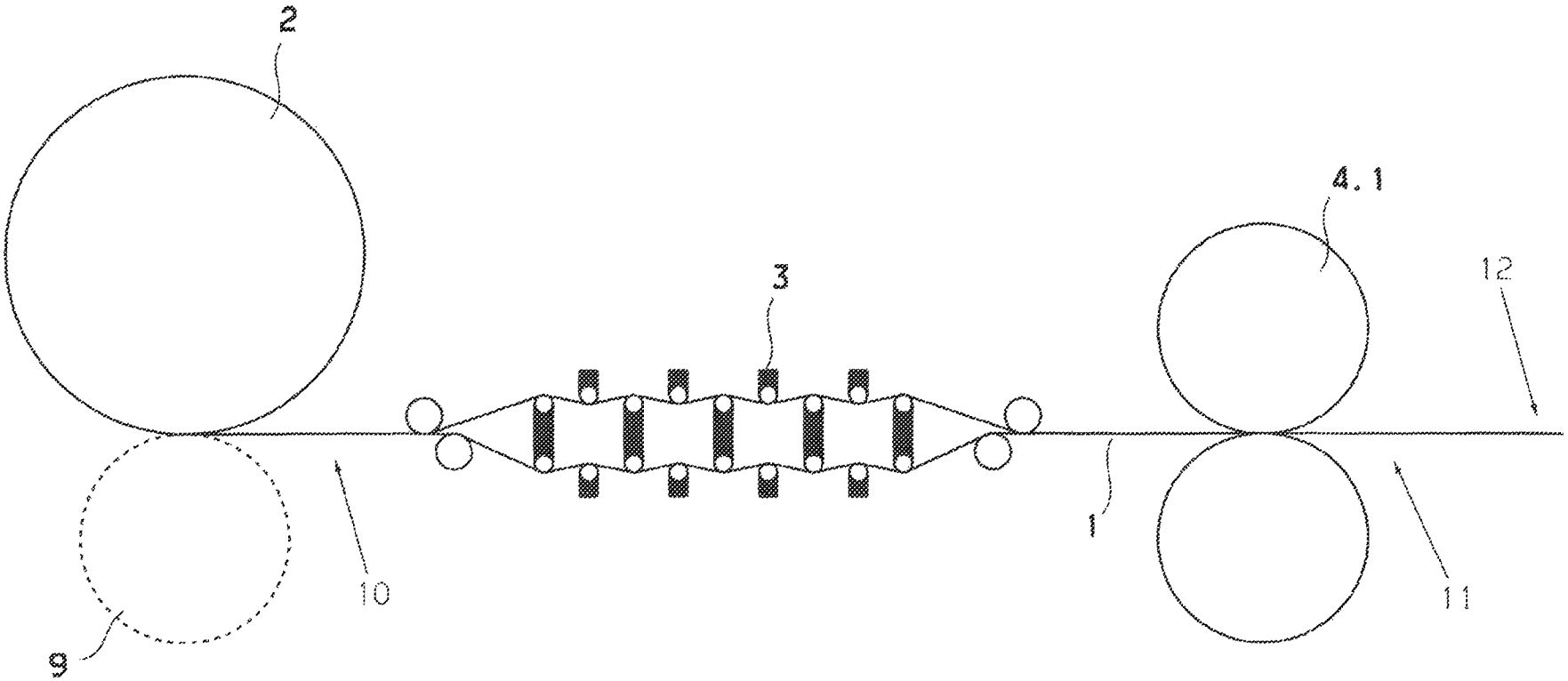
FIG. 7 illustrates a portion of the overall assembly of FIG. 1 showing a first example of a resistance.
Figure 8:
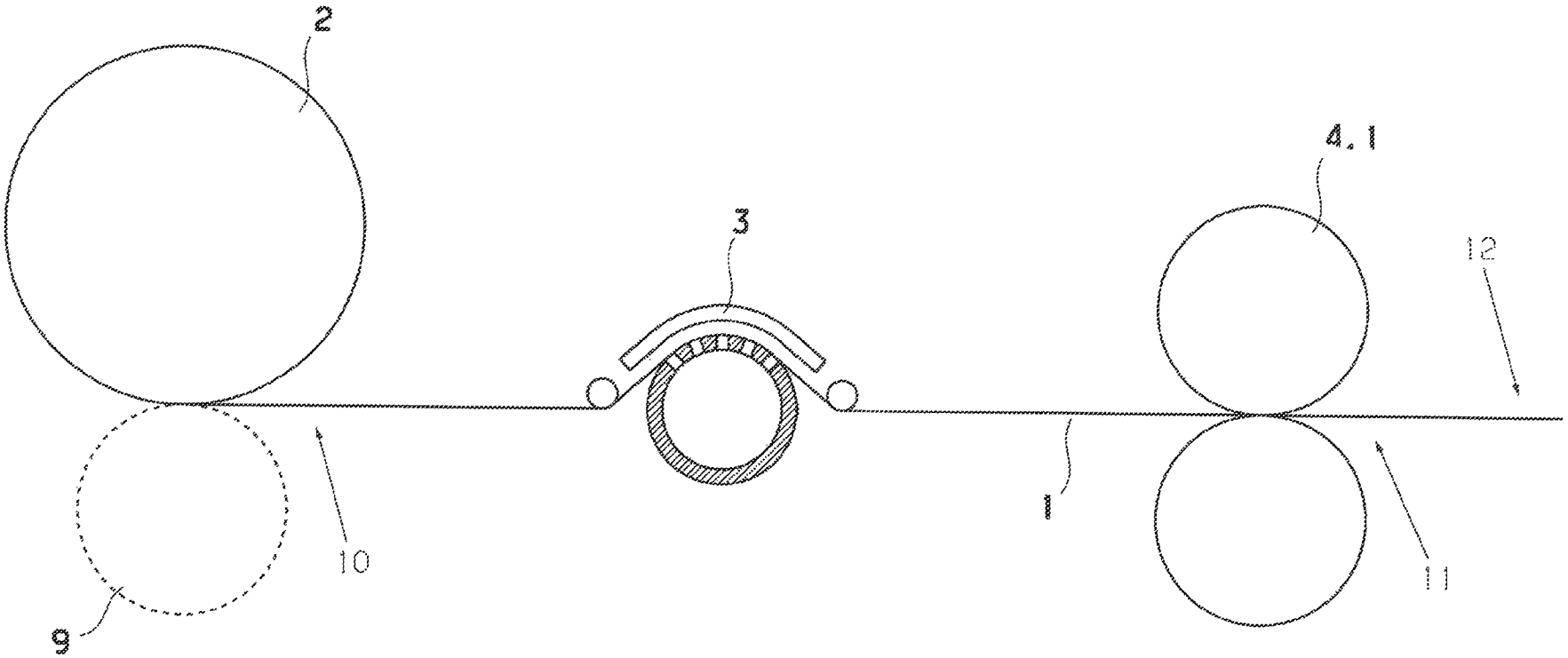
FIG. 8 illustrates a portion of the overall assembly of FIG. 1 showing a second example of a resistance.
Figure 9:
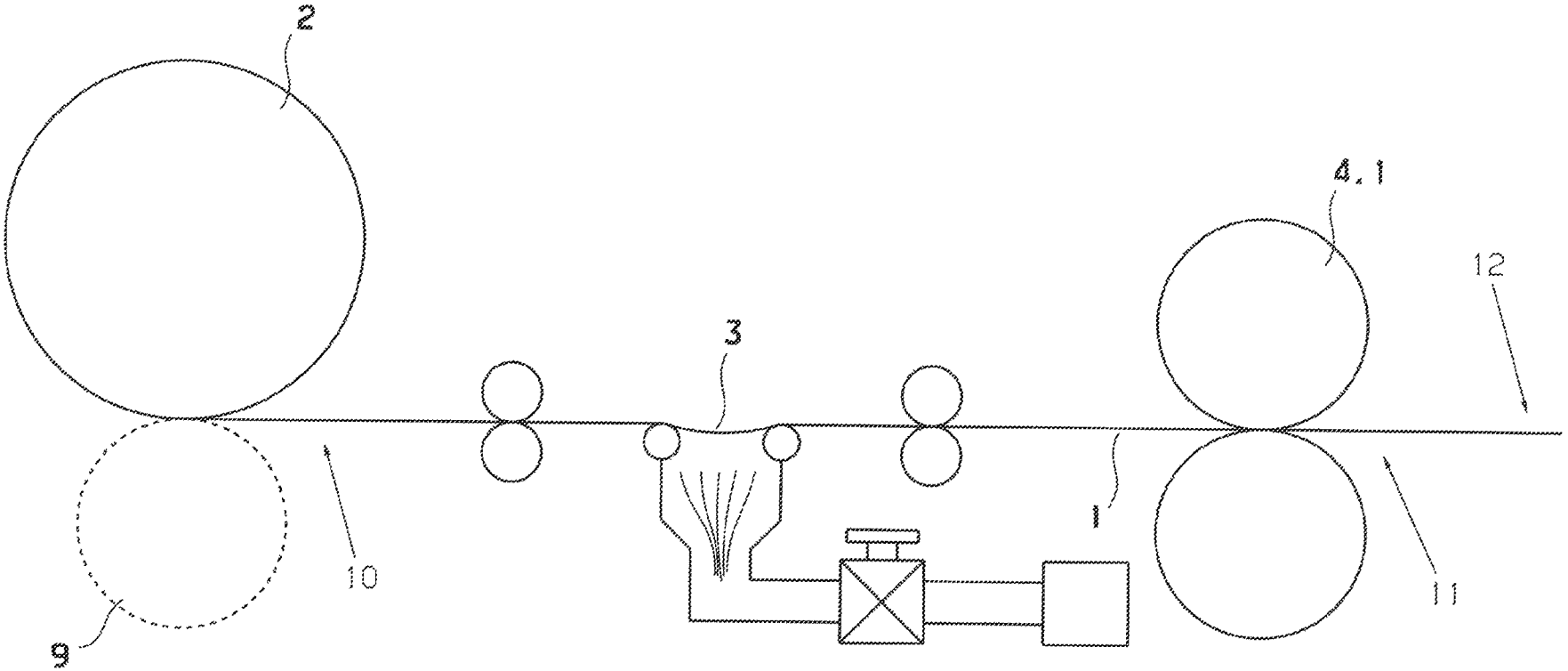
FIG. 9 illustrates a portion of the overall assembly of FIG. 1 showing a third example of a resistance.
Figure 10:
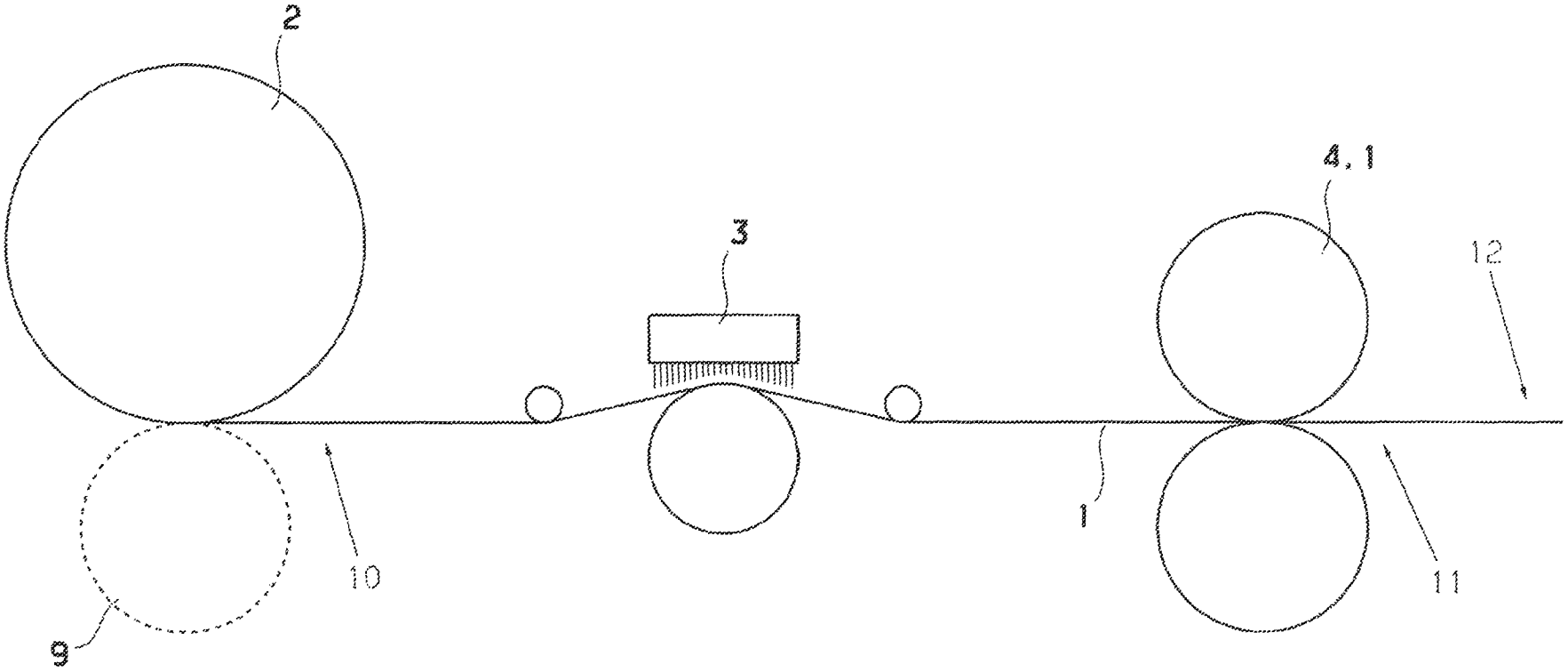
FIG. 10 illustrates a portion of the overall assembly of FIG. 1 showing a fourth example of a resistance.

Finally, an example of the fibre bundle conveyed through the spreading device is illustrated in FIG. 6. In relation to the conveying speed of the fibre bundle 1, the latter in an alternating manner by way of defined sequences is imparted an additional speed component counter to the conveying direction and subsequently in the direction of the conveying installation. In the case of two impulse drives being present, the additional speed components are out of phase. In the case of the exemplary embodiment according to FIG. 6, even in the case of the additional speed component that is directed counter to the conveying direction, the resulting value of the speed component from this additional speed component and from the conveying speed is in any case positive with respect to the speed zero, such that a corresponding tensile force is always exerted on the fibre bundle 1.

The invention claimed is:

1. A device for spreading a fiber bundle, the device comprising:

a fiber bundle supply including the fiber bundle;

a fiber take-up configured to receive the fiber bundle from the fiber bundle supply and wind up the fiber bundle or deposit the fiber bundle in segments;

a first impulse drive disposed between the fiber bundle supply and the fiber take-up, the first impulse drive configured to act on the fiber bundle such that the first impulse drive superimposes a first speed component in predefined sequences on the fiber bundle; and a resistance device disposed between the fiber bundle supply and the fiber take-up; and wherein, during spreading of the fiber bundle, the first impulse drive superimposes the first speed component in an alternating manner in the predefined sequences on the fiber bundle in the conveying direction of said fiber bundle and the first impulse drive superimposes the first speed component in the alternating manner in the predefined sequences counter to the conveying direction, or wherein, during spreading of the fiber bundle, the first impulse drive superimposes the first speed component in the alternating manner in the predefined sequences on the fiber bundle only counter to the conveying direction of the fiber bundle.

2. The device according to claim 1, wherein the first impulse drive comprises a controller configured to operate the first impulse drive in the predefined sequences of the additional speed components thereby achieving a predefined weight per unit area, the predefined sequences being varied in frequencies and/or amplitudes.

3. The device according to claim 1, wherein the resistance device comprises at least one spreading rod that is configured to be deflected transversely relative to the conveying direction of the fiber bundle, the fiber bundle being oriented at a defined wrapping angle over said at least one spreading rod.

4. The device according to claim 1, further comprising a not freely rotating package disposed upstream of the resistance device, wherein the fiber bundle supply is drawn from the not freely rotating package.

5. The device according to claim 4, wherein the not freely rotating package is a second impulse drive, the second impulse drive configured to operate, in predefined sequences in a pulsating manner in the conveying direction, wherein the predefined sequences of speed components of the second impulse drive are out of phase relative to the predefined sequences of the first speed components of the first impulse drive.

6. The device according to claim 1, wherein the resistance device is disposed downstream of the first impulse drive.

7. The device according to claim 1, wherein the take-up is a winder disposed downstream of the resistance device and is configured to receive a fiber bundle spread.

8. The device according to claim 7, wherein the winder is driven at a constant winding-up speed.

9. The device according to claim 7, wherein the winder is a second impulse drive, and wherein predefined sequences of speed components of the second impulse drive are out of phase relative to the predefined sequences of the first speed components of the first impulse drive.

10. The device according to claim 6, further comprising a second impulse drive disposed downstream of the resistance device, the second impulse drive configured to act on the fiber bundle such that the second impulse drive superimposes a second speed component in predefined sequences on the fiber bundle, wherein the second speed component is out of phase relative to the first speed component of the first impulse drive.

11. The device according to claim 5, wherein at least one of the first or second impulse drives is configured to superimpose predefined sequences of the first or second speed components, respectively, on the fiber bundle during spreading of the fiber bundle.

12. The device according to claim 1, wherein the first impulse drive is disposed downstream of the resistance device.

13. The device according to claim 1, wherein the resistance device comprises a blower device, a suction device, or an electromagnetic fiber bundle deflection device.

14. A method of spreading a fiber bundle at a defined conveying speed in a conveying direction, the method comprising:

providing a fiber bundle supply including the fiber bundle; a fiber take-up configured to receive the fiber bundle from the fiber bundle supply and wind up the fiber bundle or deposit the fiber bundle in segments; a first impulse drive disposed between the fiber bundle supply and the fiber take-up; and a resistance device disposed between the fiber bundle supply and the fiber take-up;

superimposing, via the first impulse drive, a pulsating speed component on the fiber bundle in predefined sequences in an alternating manner in the conveying direction and counter to the conveying direction.

15. The method according to claim 14, wherein superimposing the pulsating speed component comprises superimposing the pulsating speed component on the fiber bundle via a first impulse drive.

16. The method according to claim 14, wherein superimposing the pulsating speed component on the fiber bundle comprises superimposing a first pulsating speed component via the first impulse drive and superimposing a second pulsating speed component via a second impulse drive, wherein the first speed component of the first impulse drive is out of phase relative to the second speed component of the second impulse drive.

17. A device for spreading a fiber bundle, the device comprising:

a fiber bundle supply including the fiber bundle;

a fiber take-up configured to receive the fiber bundle from the fiber bundle supply and wind up the fiber bundle or deposit the fiber bundle in segments;

a first impulse drive disposed between the fiber bundle supply and the fiber take-up, the first impulse drive configured to act on the fiber bundle such that the first impulse drive superimposes a first speed component in predefined sequences on the fiber bundle;

a resistance device disposed downstream of the first impulse drive; and a second impulse drive disposed downstream of the resistance device, the second impulse drive configured to act on the fiber bundle such that the second impulse drive superimposes a second speed component on the fiber bundle;

wherein, during spreading of the fiber bundle, the first impulse drive superimposes the first speed component on the fiber bundle in an alternating manner in a conveying direction of the fiber bundle, and the second impulse drive superimposes the second speed component on the fiber bundle, and wherein the second impulse drive superimposes the second speed component out of phase relative to the first speed component.

18. A method of spreading a fiber bundle at a defined conveying speed in a conveying direction, the method comprising:

providing a fiber bundle supply including the fiber bundle; a fiber take-up configured to receive the fiber bundle from the fiber bundle supply and wind up the fiber bundle or deposit the fiber bundle in segments; a first impulse drive disposed between the fiber bundle supply and the fiber take-up; a resistance device disposed downstream of the first impulse drive; and a second impulse drive disposed downstream of the resistance device;

superimposing, via the first impulse drive, a first pulsating speed component on the fiber bundle in predefined sequences in an alternating manner, the first impulse drive superimposing the first pulsating speed component in the conveying direction superimposing, via the second impulse drive, a second pulsating speed component on the fiber bundle in predefined sequences in an alternating manner; and superimposing the second pulsating speed component out of phase relative to the first pulsating speed component.

* * * * *